United States Patent [19]

Wake

[11] 4,333,327

[45] Jun. 8, 1982

[54] MAGNETIC TUMBLER LOCK

[75] Inventor: Kiyoyasu Wake, Tokyo, Japan

[73] Assignee: Miwa Lock Co., Ltd., Tokyo, Japan

[21] Appl. No.: 119,286

[22] Filed: Feb. 7, 1980

Related U.S. Application Data

[63] Continuation of Ser. No. 867,665, Jan. 9, 1978, abandoned.

[30] Foreign Application Priority Data

Mar. 25, 1977 [NL] Netherlands .....7703227
Mar. 25, 1977 [NL] Netherlands .....7703228

[51] Int. Cl.[3] ..... E05B 47/00
[52] U.S. Cl. ..... 70/276; 70/413
[58] Field of Search ..... 70/276, 413; 335/219, 335/229, 284, 296, 297, 302

[56] References Cited

U.S. PATENT DOCUMENTS 1,965,889 7/1934 Fitzgerald ..... 70/417
3,393,541 7/1968 Wake ..... 70/276
3,654,782 4/1972 Heimann ..... 70/276
3,855,827 12/1974 Hallma ..... 70/134
3,935,720 2/1976 Boving ..... 70/276

FOREIGN PATENT DOCUMENTS 1553365 7/1970 Fed. Rep. of Germany ..... 70/276

*Primary Examiner*—Robert L. Wolfe
*Attorney, Agent, or Firm*—David L. Garrison; Randy A. Gregory

[57] ABSTRACT

The invention relates to a magnetic tumbler lock comprising an inner cylinder adapted to turn in an external housing, said inner cylinder having a keyhole for receiving a key, locking means including at least one magnetic tumbler, which is adapted to rotate about a rotary axis extending substantially transversely of the longitudinal axis of the inner cylinder, and a key which is provided with a magnet for co-operating with the magnetic tumbler causing the magnetic tumbler to rotate into an unlocked position when the key is inserted into the lock.

7 Claims, 26 Drawing Figures

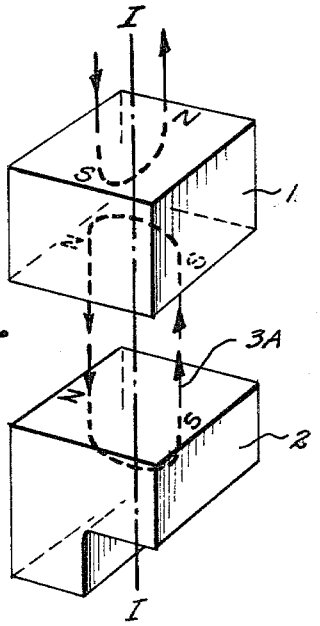
Fig. 1.
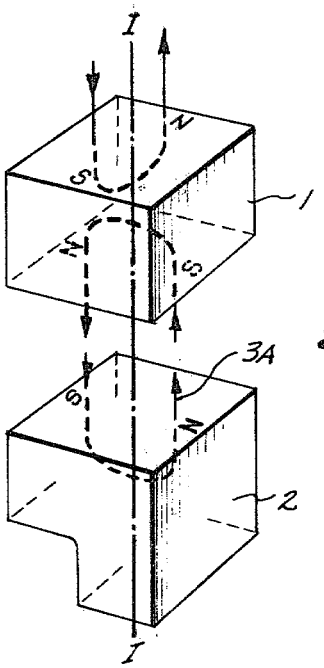
Fig. 1A.
Fig. 2.
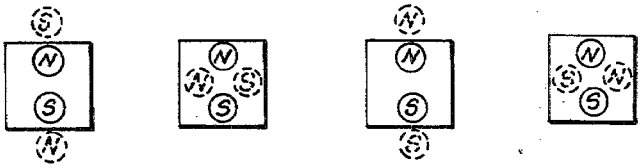
Fig. 2A.
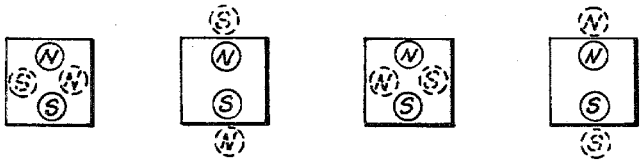
Fig. 2B.
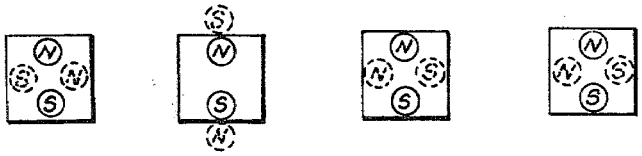
Fig. 3.
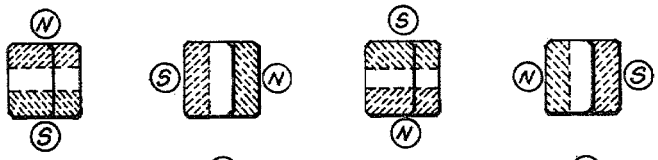
Fig. 3A.
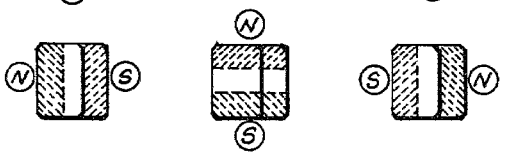
Fig. 3B.
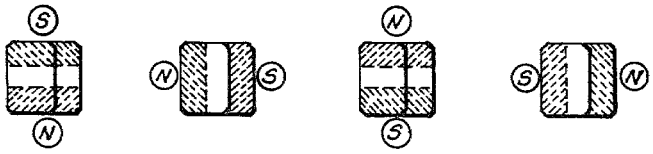

Fig. 4.
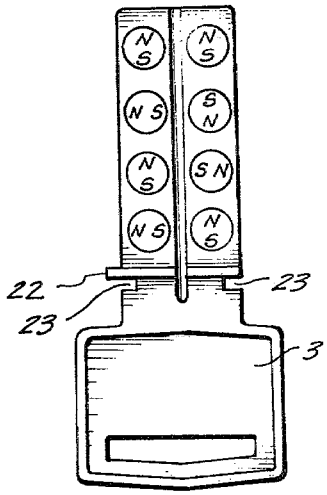
Fig. 4A.
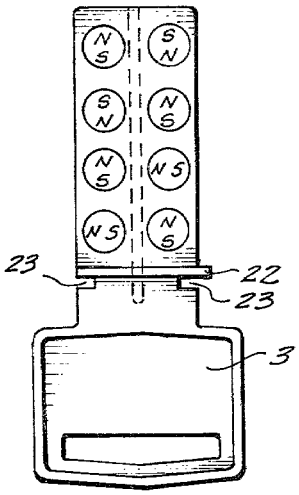
Fig. 4B.
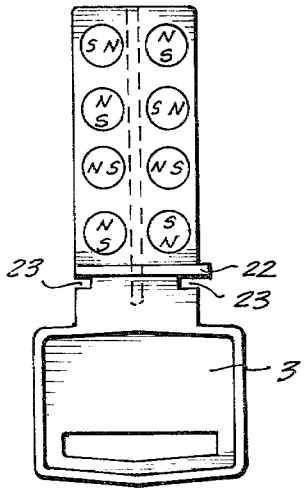
Fig. 5.
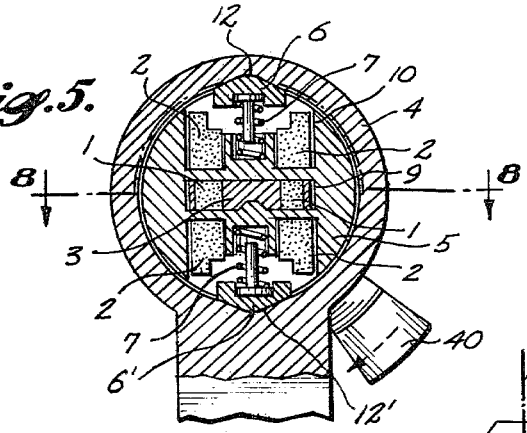
Fig. 6.
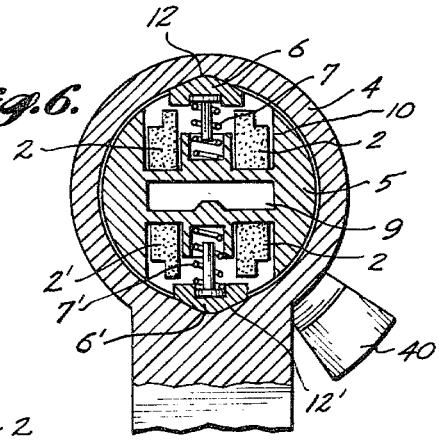
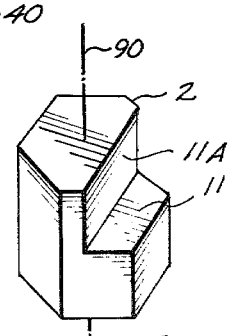
Fig. 7.
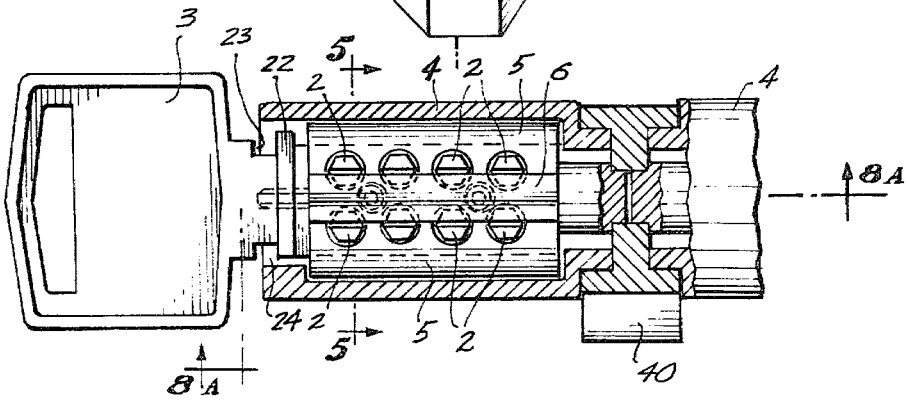
Fig. 8.

Fig. 8A.
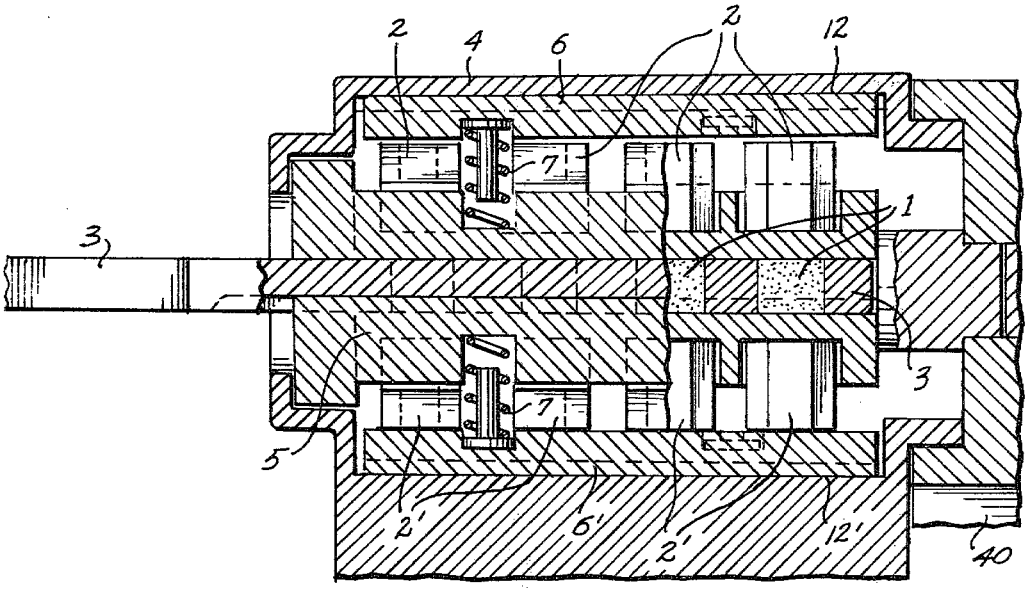
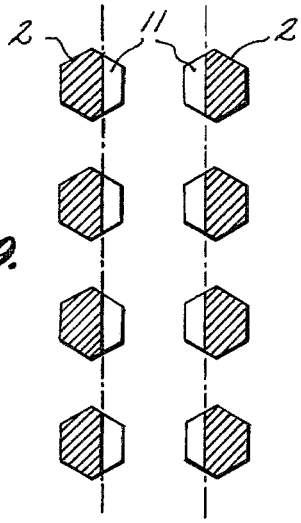
Fig. 9.
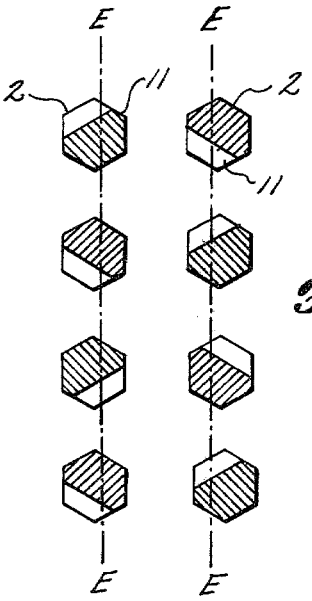
Fig. 10.
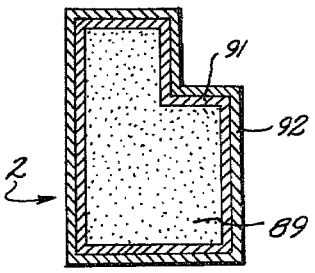
Fig. 11.

MAGNETIC TUMBLER LOCK

This is a continuation, of application Ser. No. 867,665, filed Jan. 9, 1978 and now abandoned.

BACKGROUND OF THE INVENTION

This invention relates to magnetically operated lock structures. One magnetic lock structure is known from German Pat. No. 1,553,365. In this known construction, the locking members are magnetized so that the center line of the magnetic flux extends along a straight line. The outer ends of the locking means have a particular shape such that in a first unlocked position of the locking means the outer end of the locking member can move through a circular groove in the inner wall of the housing and in a second locked position the shape of the outer end of the locking member will prevent a turn of the outer end through the groove. The manufacture of said grooves extending in the circumferential direction along the inner surface of the external housing and of the locking members with the complicated outer ends is difficult and costly. At an attempt to force the lock the comparatively weak locking members are loaded by shearing forces. If in such an arrangement the locking members are close to one another, the magnetic locking can mutually affect one another so that, when the key is inserted, the locking members will not be turned into the correct position for unlocking the inner cylinder with respect to the external housing.

In order to solve these problems, the distance between the locking members has to be increased, but then only a limited number of locking members can be arranged in an inner cylinder of given length, so that the number of variations in the disposition of the co-operating key magnets and locking member magnets is considerably reduced.

In order to mitigate the disadvantage of this known construction the invention proposes to magnetize the rotatable locking member as well as the key magnet so that the magnetic flux passes through the interior of the key magnet and through the interior of the rotatable locking member along a curved line and extends beyond the key magnet and the rotatable locking member in a direction at least substantially parallel to the rotary axis of the locking member.

With this orientation of the magnetic flux the influence of a locking member on a neighboring locking member is materially lower than in the conventional arrangement so that the locking members can be disposed relatively near one another so that a lock of given length can accommodate a comparatively large number of locking members.

Surprisingly, the number of variations in the relative positions of the key magnets and the locking member magnets can be appreciably increased by a further effect achieved by the construction according to the invention. In a known lock having magnetic locking members, the key is provided with magnetic inserts having each a magnetic flux having a straight center line so that, when this center line is at right angles to the key and a North pole is located on one side of the key, the other side of the key will have a South pole. If the center line of the magnetic flux is parallel to the key, the positions of the North and South poles on both sides of the keys will be the same.

The locking members each have a rotational axis positioned in a plane which is substantially perpendicular to the axis of the inner cylinder. The locking members co-operate with a bolt rod extending in the direction of length of the inner cylinder, the disposition being such that, in the locked position, the bolt rod extends partly in a slot in the inner wall of the external housing and partly in the inner cylinder, while the locking members are arranged below the bolt rod and prevent a displacement of the bolt rod in the direction of the longitudinal axis of the inner cylinder, whereas in the non-locked position the locking members are turned so that the bolt rod is located opposite recesses in the locking members, in which recesses it can move in the direction of the longitudinal axis of the inner cylinder.

By using the construction according to the invention, the positions of the North and South poles on one side of the key may be chosen independently of the positions of the North and South poles on the other side of the key. It will thus be obvious that the number of variations in positions of key magnets and locking member magnets can be considerably raised when locking members are disposed on both sides of the key. In this regard, the construction according to the invention is also very suitable for use in a system having a mother key. The lock can be readily manufactured at low costs, since the slot in the wall of the inner housing extends in the direction of length of the housing and the tumbler members will have a simple shape.

In attempts to force the lock, the shearing load is absorbed by the solid bolt rod and the locking members are only loaded by pressure. The locking members can better withstand pressure load than shearing load.

A further advantage of the construction according to the invention is that it is not possible to determine in any way the accurate positions of the magnetic poles of the locking members so that the lock has a high safety against burglary.

Since the method of obtaining a magnetic flux having a curved center line is known, it is not necessary to include this method in the description of the construction according to the invention.

BRIEF DESCRIPTION OF THE DRAWINGS

The invention will be described more fully hereinafter with reference to an embodiment of the construction in accordance with the invention illustrated in the accompanying Figures.

FIG. 1 illustrates schematically the disposition of a key magnet and magnetic locking member or tumbler magnet for explaining the principle of the invention.

FIG. 1A illustrates rotation of the tumbler magnet to its unlock position by influence of the presence of the key magnet.

FIGS. 2, 2A and 2B show three of the many possible arrangements of key magnets which may be employed in the construction according to the invention.

FIGS. 3, 3A and 3B show three of the many possible arrangements of the tumbler magnets which may be employed in the construction according to the invention.

FIG. 4 is a plan view of one surface of a key showing schematically one of the many possible configurations of magnet poles usable in this invention.

FIGS. 4A and 4B show plan views of the opposite side of the key shown in FIG. 4 demonstrating two of the possible dispositions of the key magnets.

FIG. 5 is a cross-sectional view of an embodiment of a lock in accordance with the invention, taken along lines 5—5 of FIG. 8, a key being inserted into said lock.

FIG. 6 shows the same cross-sectional view as FIG. 5, the key being, however, removed.

FIG. 7 is a perspective view of a locking member used in the lock shown in FIGS. 5 and 6.

FIG. 8 is a sectional view of the lock taken on the line 8—8 in FIG. 5.

FIG. 8A is a cross-sectional view, taken along line 8A—8A of FIG. 8.

FIG. 9 illustrates the position of the rotatable tumbler magnets when the key is inserted into the lock.

FIG. 10 illustrates the position of the rotatable tumbler magnets when the key is taken out of the lock.

FIG. 11 is a cross-sectional view of one form of a tumbler magnet.

DETAILED DESCRIPTION OF THE DRAWINGS

Figure 12:
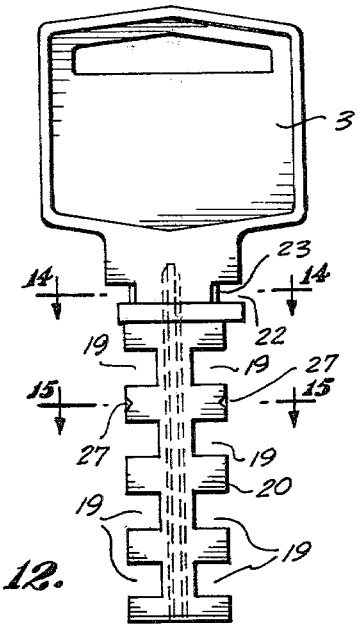
FIG. 12 is a plan view of one surface of the magnetic key prior to installation of magnets therein.
Figure 13:
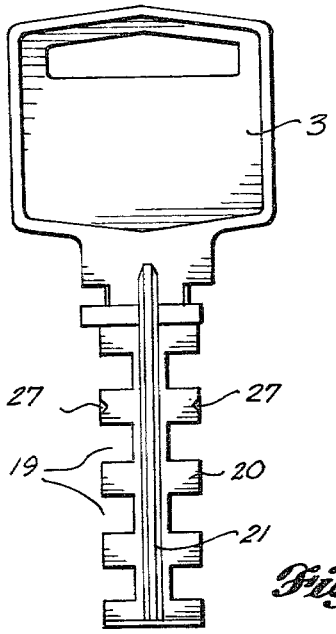
FIG. 13 is a plan view of the opposite side of the key shown in FIG. 12.
Figure 14:
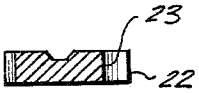
FIG. 14 is a cross-sectional view of the key shown in FIG. 12 taken along lines 14—14 thereof.
Figure 15:
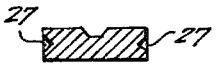
FIG. 15 is a cross-sectional view of the key shown in FIG. 12 taken along lines 15—15 thereof.
Figure 16:
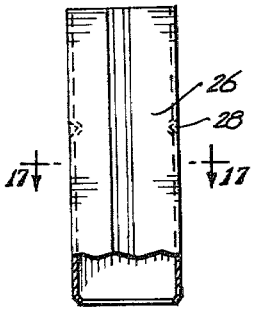
FIG. 16 is a plan view of the cap for the key shown in FIG. 12.
Figure 17:
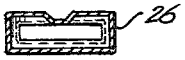
FIG. 17 is cross-sectional view of the cap shown in FIG. 16 taken along lines 17—17 thereof.

FIG. 1 shows schematically the disposition of a key magnet 1 occupying a fixed position in a key and of a tumbler magnet 2, rotatably arranged in a lock in a manner such that the tumbler magnet can turn about its center line I—I.

It will be apparent from FIG. 1 that the tumbler magnet 2 is magnetized so that the center line 3A of the magnetic flux extends along a curved line across the body of the tumbler magnet 2, entering the top surface of the body of the tumbler magnet 2 at the South pole in a direction normal to said surface and parallel to the axis of rotation I—I and leaving the body of the tumbler magnet at the North pole in a direction parallel to the direction of entering at the South pole.

From FIG. 1 it will furthermore be seen that the lower end of the key magnet 1 is magnetized in the same manner as the top end of the tumbler magnet 2.

It will be obvious that when the key magnet 1 is held above the body of the tumbler magnet 2 in the position shown in FIG. 1, the magnetic forces exerted upon the body of the tumbler magnet 2 will cause tumbler member 2 to turn about its rotary axis I—I until the North pole of the body of the tumbler magnet is opposite the South pole of the key magnet and the South pole of the tumbler magnet is opposite the North pole of the key magnet as illustrated in FIG. 1A.

FIG. 1 furthermore shows that the top end of the key magnet 1 remote from tumbler magnet 2 shown in FIG. 1 may also be magnetized in the same manner as the lower end of the key magnet, in which case, however, the co-operating North and South poles at the top end may be disposed in any desired angular orientation about axis I—I with respect to the North and South poles at the lower end of the key magnet. This top end may co-operate with another tumbler magnet (not shown) arranged above the key magnet. Of course, the position of the North and South poles of this further tumbler magnet has to correlate with the position of the North and South poles of the top end of the key magnet in order to move this upper tumbler magnet into the correct position when the key magnet is placed opposite said tumbler magnet.

FIGS. 2, 2A and 2B show some of the many possible arrangements of the magnets in the key in which the position of the North and South poles at the top of the key magnet is indicated by solid lines and on the lower side by broken lines. In the preferred embodiment of this invention two rows of four magnets each are utilized in the key, permitting many possible combinations for the lock mechanism.

FIGS. 3, 3A and 3B show three of the many possible combinations of orientations of tumbler magnets. The orientation chosen must match the magnet orientations of the key as is shown in FIGS. 1 and 1A.

FIGS. 4, 4A and 4B show several more of the many possible key magnet arrangements shown in a representation of the key for clarity.

FIG. 4 shows one side of a key 3 having two parallel rows of key magnets, each row containing four magnets. The disposition of the North and South poles of the eight key magnets on the side of the key shown may have any desired pattern. By magnetizing the key magnets in the manner described above this pattern is independent of the pattern of the poles of the key magnets on the other side of the key and thus, as is shown in FIGS. 4A and 4B, the other side of the key may have the pattern illustrated at FIG. 4A, or the pattern shown in FIG. 4B. As a matter of course, the position of the North and South poles on the tumbler magnets 2 has to correspond to the position of the poles on the key magnets co-operating with said tumbler magnets in order to obtain the correct positions of the tumbler magnets when the key is fully inserted into the lock. It will be obvious that, in this way, a particularly large number of combinations can be obtained by a comparatively small number of tumbler magnets and corresponding key magnets for a lock structure.

One preferred embodiment of a lock constructed on the basis of the principles of the invention is shown in FIGS. 5 to 8A. These FIGURES show that the lock structure is enclosed within an external housing 4. An inner cylinder 5 is positioned in the housing 5 rotatable about its longitudinal axis. The cylinder has a keyhole 9 for receiving the key 3.

On either side of the keyhole 9 four parallel rows of tumbler magnet holes 10 are provided in which the rotatable tumbler magnets 2 are disposed so that each tumbler magnet can turn about its rotary axis independently of the other tumbler magnets, each tumbler magnet axis being positioned in a plane which is substantially perpendicular to the longitudinal axis of the inner cylinder.

From FIGS. 5 and 6 it will be apparent that the rotary axes of the tumbler magnets 2 are all parallel to one another and the rotary axes of a row of tumbler magnets located on one side of the key hole are preferably located in the same plane as the rotary axis of a further row of tumbler magnets located on the other side of the keyhole.

From FIG. 7 it will be seen that each tumbler magnet 2 is formed by a body having a regular cross-section, whereas the free outer end of this body remote from the keyhole has a recess bounded by a first surface 11 at right angles to the rotary axis 90 of the tumbler magnet 2 and by a second surface 11A parallel to the rotary axis 90. Referring again to FIGS. 5 and 6, two rows of tumbler magnets 2 and 2' located each on one side of the keyhole co-operate with a bolt rod 6 and 6' extending parallel to the longitudinal axis of the lock. Each bolt rod 6 and 6' is biased by a plurality of springs 7 arranged between the inner cylinder 5 and the bolt rod 6. Thus, the springs tend to expel the bolt rods 6 outwards in the direction of the inner circumference of the housing 4 in which two slots 12 and 12' are provided for receiving the outer parts of the bolt rods 6. It will be obvious that the inner cylinder 5 cannot turn with respect to the housing 4, when the bolt rods 6 are held in the slots 12 in the manner illustrated in FIG. 6, but cylinder 5 is free to turn with respect to housing 4 when the bolt rods 6 are permitted to move inwardly as illustrated in FIG. 5.

When the key is taken out of the keyhole, the tumbler magnets 2 turn relatively to one another owing to the interacting magnetic forces of the tumbler magnets 2 and the withdrawing key magnets so that an irregular disposition of the tumbler magnets is obtained as is shown schematically in FIG. 10. In this position of the tumbler magnets certain of the free ends of the tumbler magnets are located beneath the bolt rods as illustrated in FIG. 6 so that the bolt rods cannot move inwardly and a turn of the inner cylinder relative to the external housing is not possible.

If the correct key 3 is inserted into the keyhole 9 so that the correct key magnets 1 arrive opposite the co-operating tumbler magnets 2, the tumbler magnets 2 will be turned so that the surfaces 11A of the tumbler magnets of each row are brought in line in plane E—E and E'—E' as illustrated in FIG. 9, the surfaces of 11A of two rows of tumbler magnets located on the same side of the keyhole then facing one another. As illustrated in FIGS. 9 and 5 there will be formed a slot defined by surfaces 11 and 11A of the tumbler magnets located on one side of the keyhole 9, into which the bolt rod 6 can be moved by the cam action of the slanting walls of the slot 12, when the inner cylinder is turned with the aid of the key.

The disposition described of the bolt rod 6 and tumbler magnets 2 has a number of advantages.

The tumbler magnets 2 may have a simple shape so that their manufacture is easy. The machining of the slots 12 and 12' extending in the direction of length of the housing 4, will not give rise to difficulties in manufacture.

Rotation of the inner cylinder 5 relative to the external housing 4 is prevented by the solid bolt rods 6 and not by the magnetic tumblers 2 when the key 3 is not inserted into the lock mechanism. If attempts are made to turn the inner cylinder 5 without using the correct key, the magnetic tumblers 2 receive compressive thrust from the bolt rods 6 preventing rotation of the inner cylinder 5.

In general, the magnetic parts are made from a material of comparatively poor mechanical properties and the material may even sometimes be brittle. Such materials possess adequate strength to handle compressive thrust loads such as imposed by the lock structure, whereas shear forces imposed upon such materials by prior art structures can result in fracture of the locking elements with resultant forcing open of the lock. The lock structure shown herein is better able to withstand such forces.

In view thereof, according to a further aspect of the invention, the locking members are coated with metal in any one of a number of processes, such as by electrolytic or electroless techniques. As shown in FIG. 11, it is preferred to apply a first layer 91 of copper having a good affinity with the magnetic material 89 and a second layer 92 of nickel having satisfactory mechanical properties, said outer layer being resistant to wear and having a low friction, all as shown in FIG. 11. In addition to the wear resistance and low frictional qualities the metal coating on the surface imparts a very substantial improvement to the strength of the locking member thereby improving the overall performance of the lock in preventing forced opening. FIG. 11 shows the thickness of a layer on an exaggerated scale for the sake of clarity, but these layers may be very thin so that the weight of the locking members will hardly increase by the layers of metal.

The structure of the magnetic key suitable for use in this invention is shown more clearly in FIGS. 12 through 17. In the preferred embodiment shown, apertures for four magnetic elements are provided in the key skeleton 20. A groove 21 is cut along the length of the key to mate with a lock projection to insure the proper angular orientation of the key with respect to the lock mechanism. A tang 22 and corresponding recess 23 permit insertion of the key into the lock and removal thereof in a single angular position of the lock. It will be noted from FIG. 8 that a portion of the external housing 4 has been relieved to permit insertion of the tang 22 within the housing 4. Rotation of the key 180° will line the key up again with slot keyhole 9. However, the projection 24 will prevent removal of the key from the lock mechanism due to inter-engagement with tang 22.

Figure 18:
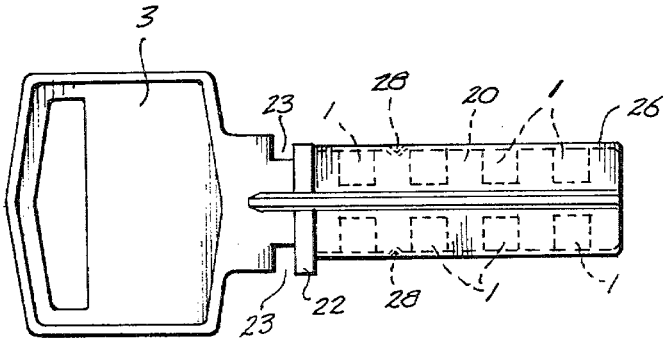
FIG. 18 is a plan view of a key having a cap placed thereon for holding the key magnets in place.

Referring again to FIGS. 12 through 17, the key magnets are received in recesses 19 and held in place by cap 26, shown in FIGS. 16 and 17. Cap 26 holds the key magnets in place by sliding axially over the magnets and key to the position best shown in FIG. 18. The edges of cap 26 are pressed into depressions 27 on the key spine by forming impressions 28 with a suitable tool such as a center punch. Cap 26 is thus held in place and is not readily removed from the key 3.

The apparatus shown in this invention may be utilized as a single lock, for example, in cabinet structures, or may advantageously be formed with two of the structures shown in FIG. 8A, arranged axially with access by key to each side. Such a structure may be advantageously used in, for example, a door for a dwelling or other structure. It will be apparent that many thousands of combinations are possible with the applicant's unique lock structure, since the combinations are practically limitless due to the possibilities of various angular orientations of the two magnets at each position of key 3. In addition, the practically limitless angular orientations possible of the tumbler magnet shown in FIG. 7, with respect to its magnetic poles provides further latitude in the number of possible combinations which may utilized in this lock structure. A further advantage of the magnet lock structure of this invention is that it is nearly impossible to copy the key without prior knowledge of the magnetic orientations of the various key magnets. It may be possible with sophisticated equipment to determine the angular orientation of the various magnets in the key. However, the cost of such detection equipment would deter most unauthorized individuals from attempting to counterfeit keys.

What is claimed is:

1. A magnetic actuated lock mechanism comprising an external housing, an inner cylinder which is adapted to turn in said external housing, said inner cylinder having a keyhole for receiving a key axially therein, there being arranged two rows of tumbler magnets in said inner cylinder, said tumbler magnets being adapted to turn about a rotary axis transverse of the longitudinal axis of the inner cylinder; said tumbler magnets being magnetized through a process of partial magnetization producing both a north and south magnetic poles on the end adjacent to said keyhole; a magnetic key provided with a key magnet corresponding to each of said tumbler magnets for co-operating with each of said tumbler magnets, said key magnets being magnetized through a process of partial magnitization producing both a north and south magnetic poles on the end adjacent to said tumbler magnets, said tumbler magnets and said key magnets being substantially coaxially oriented in pairs so that the magnetic flux passes through the interior of the key magnets and through the interiors of the rotatable tumbler magnets along a curved line and beyond the key magnets whereby each tumbler magnet is rotatably operable by a single key magnet and said tumbler magnets are each rotated into an unlocked position upon insertion of said key; and a bolt rod extending in the direction of length of the inner cylinder, adjacent said two rows of tumbler magnets, said mechanism constructed and arranged such that, in said locked position of said tumbler magnet, the bolt rod is locked outwardly abutting the top surface of said tumbler magnets and within an interior slot in the external housing preventing relative angular displacement between said inner cylinder and said external housing and in said unlocked position of said tumbler magnets, the bolt rod is movable inwardly toward the longitudinal axis of the inner cylinder into a slot formed by aligned recesses in said tumbler magnets when said tumbler magnets are rotated into the unlocked position by insertion of a proper magnetic key, whereby said inner cylinder is rotatable with respect to said external housing.

2. A lock as claimed in claim 1, wherein the key magnets in said key are partially magnetized with both a north and south magnetic poles at each end adjacent to the tumbler magnets and positioned transversely of the key, said inner cylinder having a plurality of tumbler magnets positioned in sets of two rows adjacent each side of the keyhole for substantially coaxial co-operation with the key magnets.

3. A lock as claimed in claim 1, wherein the tumbler magnets are constructed of a magnetic material having a first layer of copper plated thereon and a second outer layer of nickel plated thereover, said layer of nickel having satisfactory mechanical properties to resist wear and have a low friction including contact with other lock components, whereby said locking members have a very substantial improvement in strength and resistance to sticking or jamming.

4. The apparatus of claim 1, wherein said bolt rod is biased outwardly into said interior slot with a spring means.

5. The apparatus of claim 1, wherein said interior slot has cam faces thereon urging said bolt rod inwardly upon rotation of said inner cylinder with respect to said housing.

6. The apparatus of claim 1, wherein two sets of two parallel rows of magnetic tumblers are positioned on opposite sides of said keyhole, said magnetic tumblers in each of said sets of two parallel rows co-operating to form a passageway to receive a bolt rod, said bolt rods being movable from a first, housing engaging position to a second position within said passageway upon insertion of said key into said keyhole.

7. The apparatuses of claim 6 wherein the key has a tang located thereon for insertion into a recess whereby the key is prevented from removal except as specific angular orientations of the inner cylinder with respect to the outer housing; said key also having a groove formed therein for mating with a projection in said keyhole whereby proper orientation of said key with respect to said inner cylinder is readily apparent.

* * * * *